US006336245B1

(12) United States Patent
Sakakibara

(10) Patent No.: US 6,336,245 B1
(45) Date of Patent: Jan. 8, 2002

(54) DOOR STOPPER

(75) Inventor: Toshio Sakakibara, Handa (JP)

(73) Assignee: Souken limited company (JP)

( * ) Notice: Subject to any disclaimer, the term of this patent is extended or adjusted under 35 U.S.C. 154(b) by 0 days.

(21) Appl. No.: 09/563,850

(22) Filed: May 4, 2000

(30) Foreign Application Priority Data

May 19, 1999 (JP) ..... 11-138856
Mar. 31, 2000 (JP) ..... 12-096186

(51) Int. Cl.[7] ..... E05F 5/00
(52) U.S. Cl. ..... 16/82; 16/864; 16/85
(58) Field of Search ..... 16/82, 85, 86 R, 16/86 A, 86 B, 86

(56) References Cited

U.S. PATENT DOCUMENTS 2,929,647 A * 3/1960 Gladstone ..... 16/85
3,909,877 A * 10/1975 Christy et al. ..... 16/85
4,343,500 A * 8/1982 Steiner ..... 292/175
4,462,623 A * 7/1984 Grant ..... 292/175
4,797,970 A * 1/1989 Charlton ..... 16/82
4,823,432 A * 4/1989 Jan ..... 16/86 A
5,018,241 A * 5/1991 Baines ..... 16/82
5,120,093 A * 6/1992 Carney ..... 292/60

FOREIGN PATENT DOCUMENTS

JP 7-286473 10/1995
JP 7-301044 11/1995
JP 11-200703 7/1999

* cited by examiner

*Primary Examiner*—Anthony Knight
*Assistant Examiner*—Mark Williams
(74) *Attorney, Agent, or Firm*—Parkhurst & Wendel, L.L.P.

(57) ABSTRACT

The door stopper of the present invention is of a construction such that a door contacting member fitted into a guide cylinder sunk vertically into the floor is allowed to be set in two positions, in a door contacting state in which it protrudes from the floor and in a housed state in which the top is substantially level with the floor. According to this construction, the floor is able to be substantially flat when the door stopper is not in use so that it does not become an obstruction to floor polishers and wheelchairs.

7 Claims, 12 Drawing Sheets

DOOR STOPPER

BACKGROUND OF THE INVENTION

1. Field of the Invention

This invention relates to a door stopper for preventing an open door from hitting a wall and which is used to keep a door open, as well as to a method for raising and lowering the door stopper.

2. Description of the Related Art

As related art of a door stopper such as that described above, art is known which has a structure having a short post at a corner portion defined by a wall and the floor, the tip of which is provided with a cushioning body for the door, and a hook for keeping the door open. However, this type of related art of a door stopper gets in the way when a floor polisher is used because the post is always protruding from the floor. Furthermore, because it is an obstruction for wheelchairs and the like, it is unsuitable for use in barrier free housing.

SUMMARY OF THE INVENTION

An object of the present invention is to provide a door stopper which solves the foregoing problems, is suitable for use in barrier free housing without becoming an obstruction to floor polishers and wheelchairs, and which functions to prevent an open door from hitting the wall and to keep a door open.

In order to solve the foregoing problems, the door stopper of the first aspect of the present invention is provided with a guide cylinder, sunk vertically into the floor, and a door contacting member able to be set in two positions, in a door contacting state in which it protrudes above the floor and in a housed state in which the top is substantially level with the floor. This construction enables the floor to be substantially flat when the door stopper is not in use so that it does not become an obstruction to floor polishers and wheelchairs.

In a preferred embodiment of the present invention, the door contacting member is constantly being forced upward by a spring disposed between the door contacting member and the guide cylinder. Moreover, a lock mechanism is provided which keeps the door lock in a housed state. This lock mechanism is preferably constructed from a pin provided in the guide cylinder and a grooved cam which is formed on the door contacting member and which engages with the pin. The grooved cam can be a heart-shaped grooved cam with a step to prevent pin reversal and the lock mechanism can be shaped so as to have horizontal portions at the top and bottom of a vertical groove. Employing this type of lock mechanism enables the door contacting member to be set in two positions, in a door contacting state with the door contacting member and in a housed state, with a simple operation.

Furthermore, in a preferred embodiment of the present invention, the structure can be such that a vertical space is formed between the door contacting member and the guide cylinder, and a closing body that closes the upper end of this space is attached to the upper portion of the guide cylinder. Accordingly, dust is able to be prevented from entering, and even if dust does get into the inner portion, it can fall out the bottom of the guide cylinder, thereby making the door stopper durable.

Moreover, as a separate embodiment of the present invention, in a method for raising and lowering the door stopper, the door contacting member is inserted into the guide cylinder sunk vertically into the floor so as to keep the door contacting member in a state wherein the top thereof is substantially the same level as the floor. With this method, the floor can be substantially flat when the door stopper is not in use so that it does not become an obstruction to floor polishers and wheelchairs.

DETAILED DESCRIPTION OF THE PREFERRED EMBODIMENTS

Figure 1:
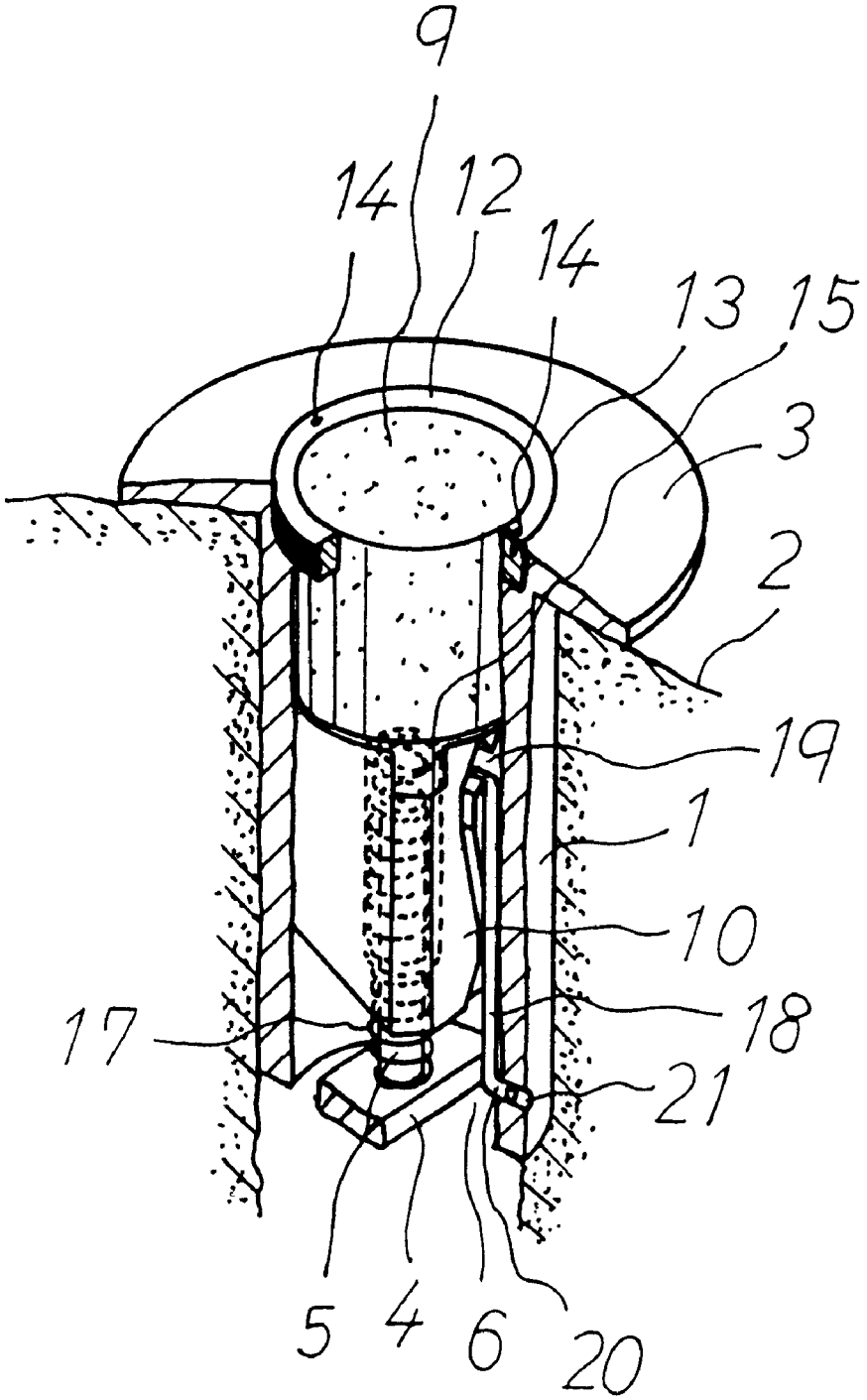
FIG. 1 is a partial cutaway perspective view showing the first embodiment of the present invention.

The preferred embodiments of the present invention will hereinafter be described in detail with reference to the drawings. However, the present invention is not limited to these embodiments.

In the first embodiment shown in FIGS. 1 through 5, a guide cylinder 1 is sunk vertically into a floor 2. In this embodiment, the guide cylinder 1 is a substantially cylindrical body of a metal such as aluminum, with a disc-shaped flange 3 formed integrated with the upper end portion thereof. It is preferable to have this flange 3 with a peripheral edge portion that is as thin as possible. The guide cylinder 1 is sunk in a hole formed in the floor so that the bottom of the flange 3 comes in close contact with the floor, as shown in the drawing, and fixed with an adhesive, for example.

Figure 5:
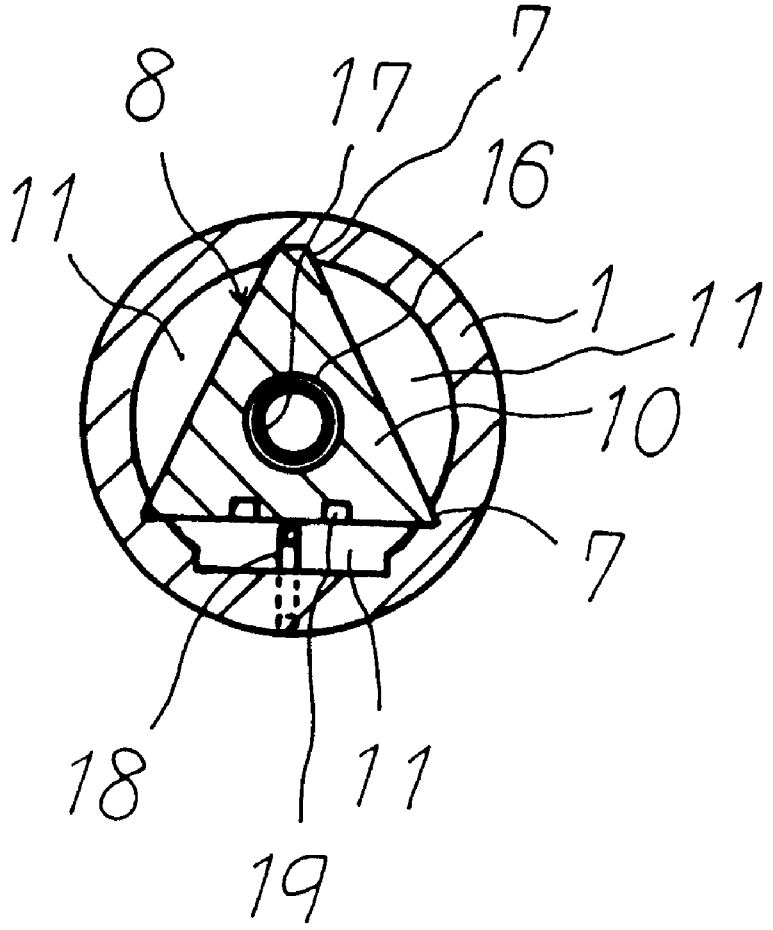
FIG. 5 is a sectional view taken along line V—V of FIG. 3.

A vertical guide pin 5 is fixed facing upward to the bottom 4 of the guide cylinder 1. The length of the guide pin 5 is approximately half the entire length of the guide cylinder 1. A through-hole 6 is formed in the bottom 4 of the guide cylinder 1 so that dust which has gotten into the inner portion falls to the bottom portion of the hole. Furthermore, a plurality of guide grooves 7, as shown in FIG. 5, are formed vertically in the inner peripheral face of the guide cylinder 1.

A door contacting member 8 is fit into the inner portion of the guide cylinder 1. This door contacting member 8 is formed of resin such as polypropylene, for example, and is composed of a circular post-shaped head portion 9 and a main body portion 10. The outer periphery of the head portion 9 is covered by a rubbery cushioning member such as rubber so as to soften the impact when the door makes contact and to prevent noise.

In this embodiment, the main body portion 10 of the door contacting member 8 is formed in a triangular pillar shape. The three ridge portions thereof engage with the aforementioned guide grooves 7 of the guide cylinder 1 such that the main body portion 10 is able to move vertically with out rotating. In this way, because the triangular pillar shaped door contacting member 8 is inserted into the inner portion of the cylindrically shaped guide cylinder 1, a plurality of spaces 11 are formed vertically therebetween, as shown in FIG. 5. These spaces 11 are provided to allow dust that has gotten into the inner portion of the guide cylinder 1 to fall through. The upper end of these spaces 11 is closed by a closing body 12 provided at the upper portion of the guide cylinder 1 so as to prevent as much as possible dust from entering.

Figure 2:
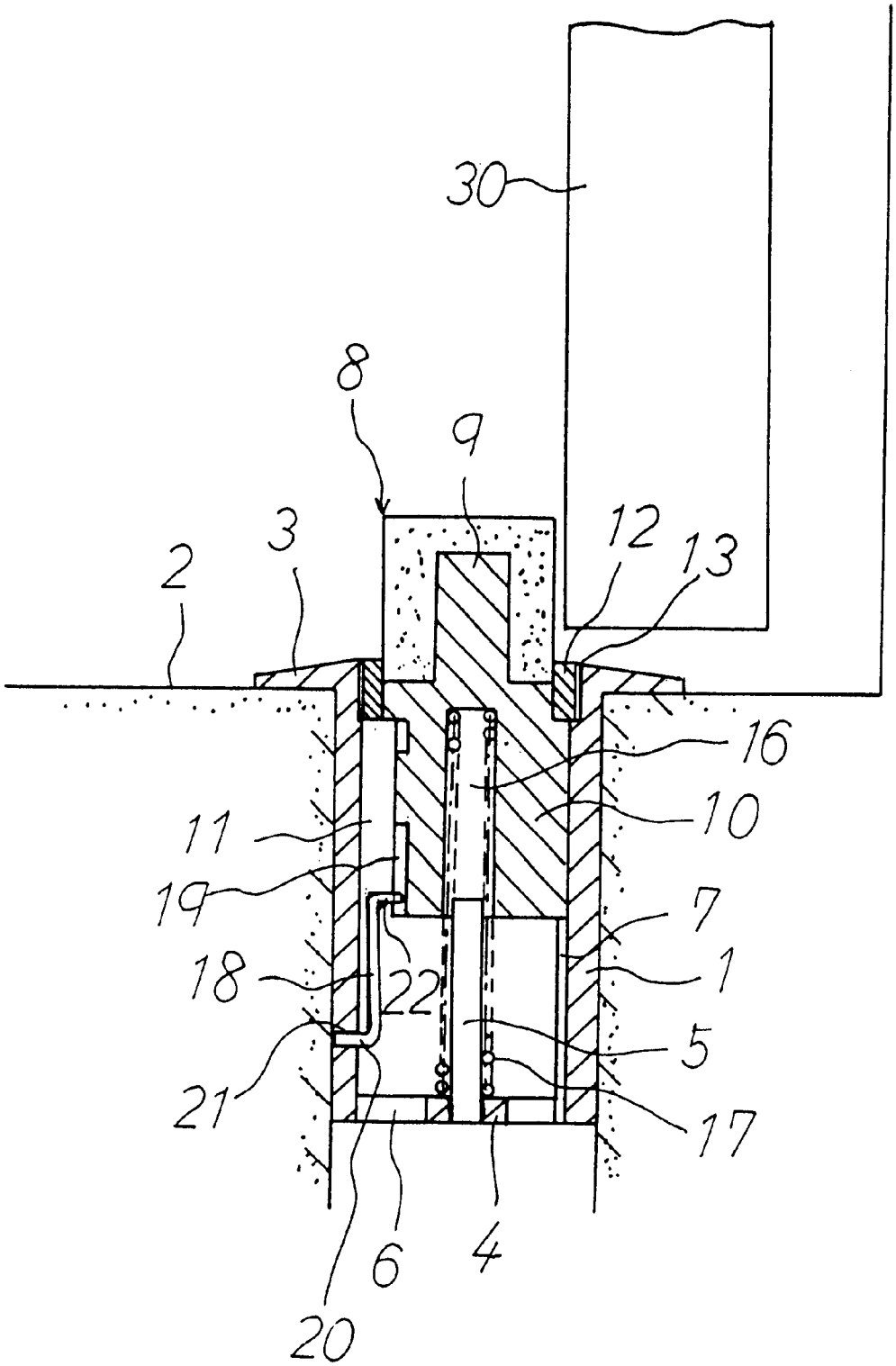
FIG. 2 is a longitudinal sectional view showing the door contacting state.

In this embodiment, the closing body 12 is a ring-shaped screw which is screwed into a female screw 13 formed in the upper portion of the guide cylinder 1. A plurality of holes 14 are formed in the upper surface of the closing body 12, as shown in FIG. 1. It is preferable that the closing body 12 be removable when necessary by inserting the tip of a wire or the like into the hole 14 and rotating the closing body 12. This type of hole 14 is beneficial in that it does not cause a protrusion from the floor. Further, because the inner diameter of the closing body 12 is smaller than the inner diameter of the guide cylinder 1, as shown in FIG. 2, the step portion 15 formed in the upper portion of the three ridge portions of the main body portion 10 of the door contacting member 8 hits this closing body 12 and is unable to pass through. Therefore, the closing body 12 also functions to regulate the maximum raised position of the door contacting member 8.

A deep hole 16 is formed in the lower portion of the main body portion 10 of the door contacting member 8, into which the upper portion of a coil spring 17 fitted in the guide pin 5 of the guide cylinder 1 is inserted. As a result, the door contacting member 8 constantly receives upward spring force at the inner portion of the guide cylinder 1.

Provided between the door contacting member 8 and the guide cylinder 1 is a lock mechanism to enable the door contacting member 8 to be set in two positions, in a door contacting state in which the top of the door contacting member 8 protrudes from the floor and in a housed state in which the top of the door contacting member 8 is substantially level with the floor. This lock mechanism is composed of a wire 18, the top and bottom of which are bent to opposite sides, and a grooved cam 19 formed on one side of the main body portion 10 of the door contacting member 8. A lower bent portion 20 of the wire 18 is inserted into a hole 21 in the lower portion of the guide cylinder 1 and an upper bent portion 22 of the wire 18 is fitted into the grooved cam 19.

Figure 4:
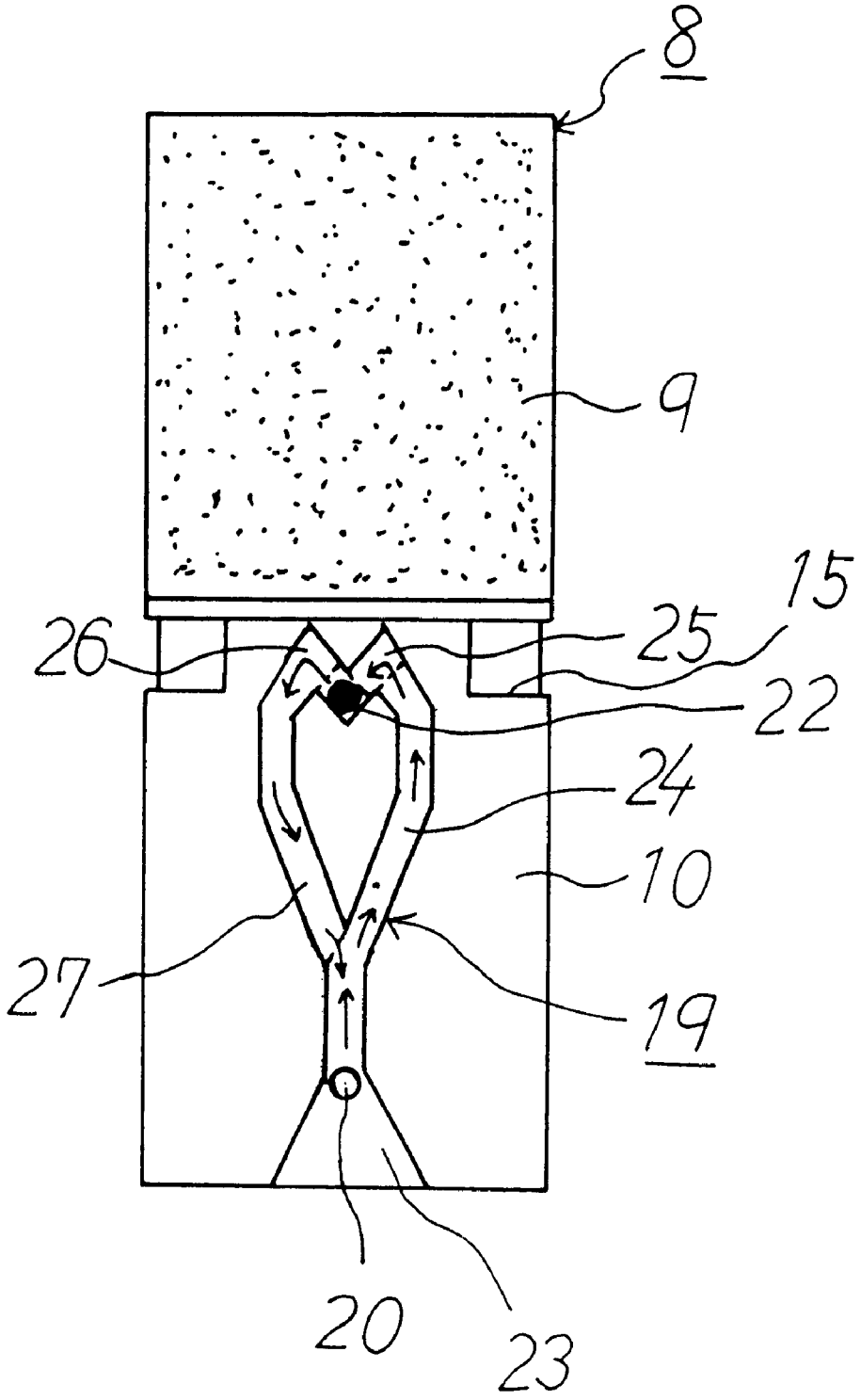
FIG. 4 is a side view of the door contacting member.

The grooved cam 19 is formed in a substantially heart shape and a lower portion 23 widens in a triangular shape, as shown in FIG. 4. The grooved cam 19 is composed of a right side groove 24, an upper right side groove 25, an upper left side groove 26, and a left side groove 27. With the connecting portions of each groove, a step is formed to prevent reversal, such that the larger the number of the groove, the greater its depth. The upper bent portion 22 of the wire 18 is forced toward the grooved cam 19 by its own elasticity such that when it moves (raises and lowers) relatively inside the grooved cam 19, its route will always be from the right side groove 24 to the upper right side groove 25 to the upper left side groove 26 to the left side groove 27, with no reversal. This means that, in particular, the upper bent portion 22 of the wire 18 which has reached the top of the right side groove 24 will always enter the upper left side groove 26, and the upper bent portion 22 of the wire 18 which has reached the top of the upper left side groove 26 will always enter the left side groove 27.

As described above, the door contacting member 8 is constantly being forced upward by the coil spring 17. However, when the upper bent portion 22 of the wire 18 is a V-shaped portion defined by the upper right side groove 25 and the upper left side groove 26, as shown by the black dot in FIG. 4, the door contacting member 8 is brought into a locked state in which upward movement is restricted by the wire 18. This state is the housed state shown in FIG. 3, wherein the top of the door contacting member 8 is substantially level with the floor. However, when the upper bent portion 22 of the wire 18 slips out of this V-shaped portion, the door contacting member 8 is pushed upward by the coil spring 17 so that it is brought into a door contacting state. The maximum raised position in this state is regulated by the closing body 12, as described above.

Figure 3:
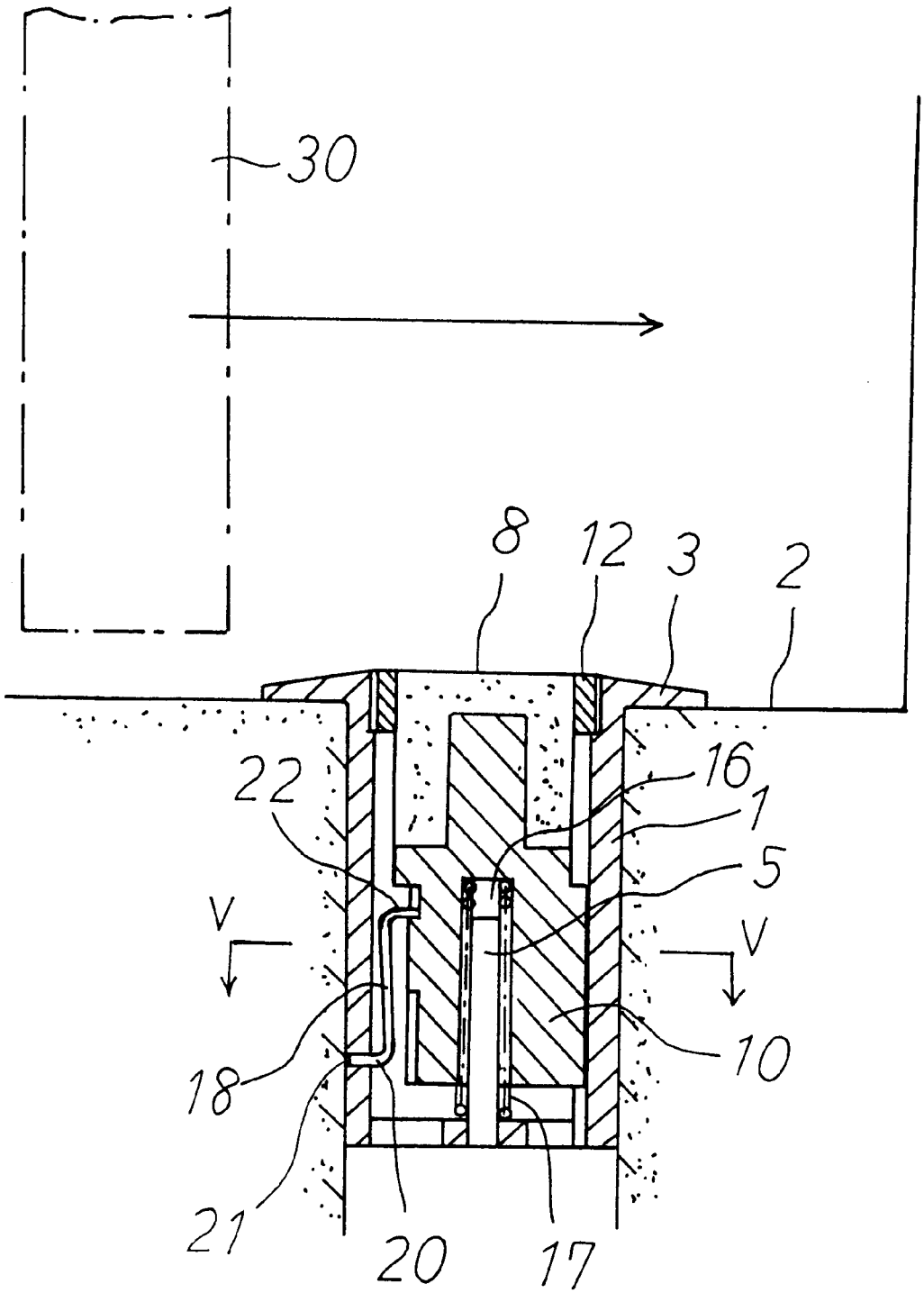
FIG. 3 is a longitudinal sectional view showing the housed state.

With this door stopper, when the door contacting member 8 is pushed down against the coil spring 17, as shown in FIGS. 1 and 3, the upper bent portion 22 of the wire 18 moves relatively upward inside the grooved cam 19 such that it reaches the upper end of the right side groove 24. From this state, when the downward pushing force of the door contacting member 8 is released, the door contacting member 8 is pushed somewhat upward so that it returns by the force of the coil spring 17. At the same time, the upper bent portion 22 of the wire 18 moves into the upper right side groove 25 and reaches a position shown by the black dot in FIG. 4. In this state, the door contacting member 8 is locked and in a state where it is housed in the inner portion of the guide cylinder 1. In this housed state, almost no portion protrudes above the floor so it does not get in the way of wheelchairs and during floor cleaning.

In this state, after opening a door 30, as shown in FIG. 3, when the door contacting member 8 is again pushed down slightly against the coil spring 17, the upper bent portion 22 of the wire 18 enters the upper left groove 26 from the position shown by the black dot in FIG. 4. Then, when the downward pushing force of the door contacting member 8 is released, the upper bent portion 22 of the wire 18 enters the left side groove 27 such that the lock slips out and the door contacting member 8 is brought into the door contacting state in which it protrudes from the floor, as shown in FIG. 2. In this state, the door 30 is pinned between the wall and the door contacting member 8 such that it is kept open.

Almost no portion of the aforementioned door stopper protrudes above the floor when it is in a housed state so it does not get in the way of wheelchairs and during floor cleaning. Furthermore, switching between the housed state and the door contacting state is able to be done with only the operation of pushing in the door contacting member so that it can also be operated with a foot, thereby eliminating the necessity of bending over as in the past. Moreover, because the door stopper of the present invention is located on the floor, it is possible for dust to get in. However, the closing body covering the periphery of the door contacting member prevents this from happening. Also, even if minute amounts of dust do get into the inner portion of the guide cylinder when the door contacting member is temporarily raised, it falls downward through the vertical spaces formed between the door contacting member and the guide cylinder and the through-hole in the bottom. Therefore, there is no fear of the raising and lowering of the door contacting member being obstructed by dust and thus the door stopper has many merits such as long-term durability. Needless to say, the door stopper can also be used to prevent a door from hitting the wall when it is opened.

Figure 6:
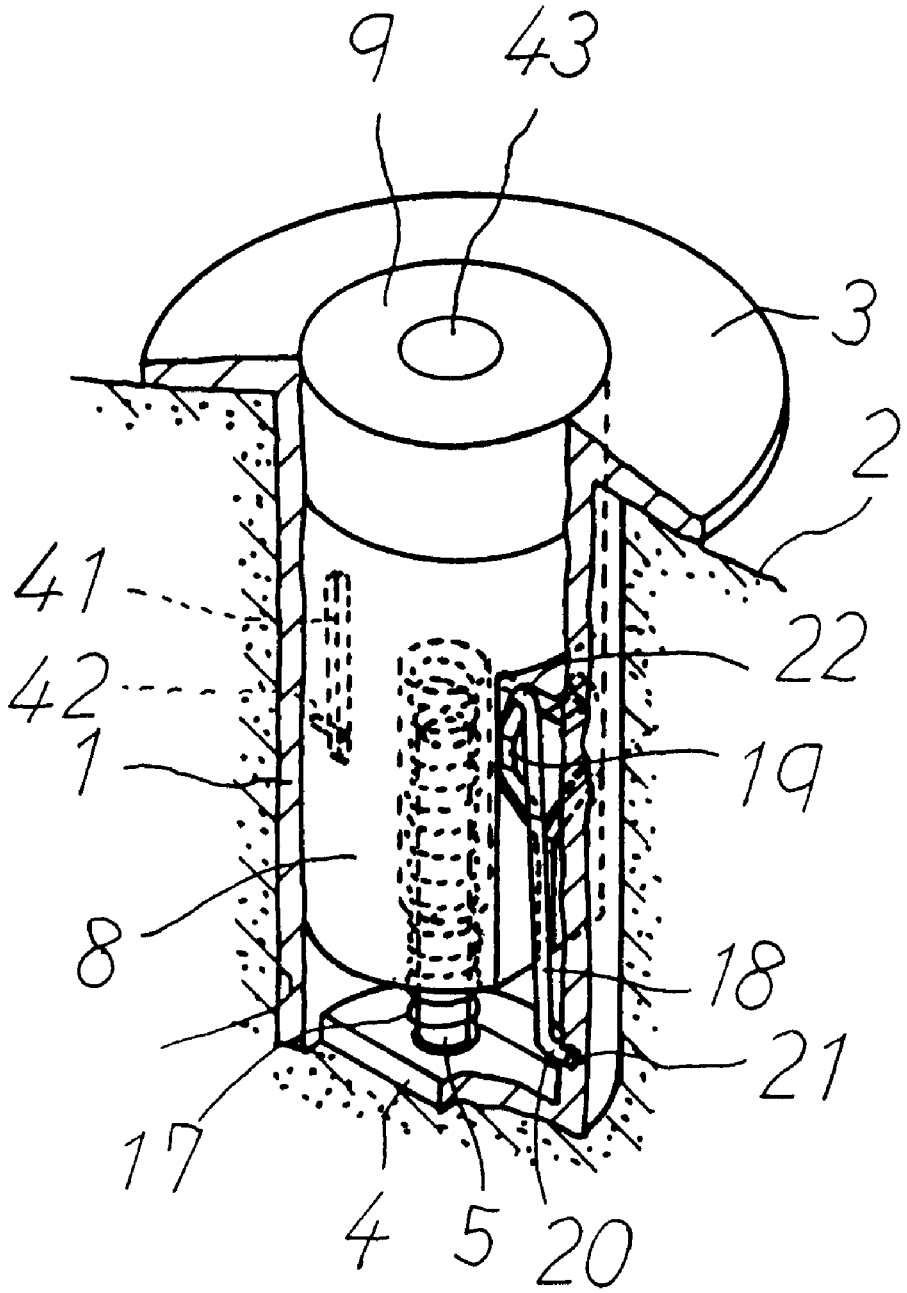
FIG. 6 is a partial cutaway perspective view showing the second embodiment of the present invention.
Figure 7:
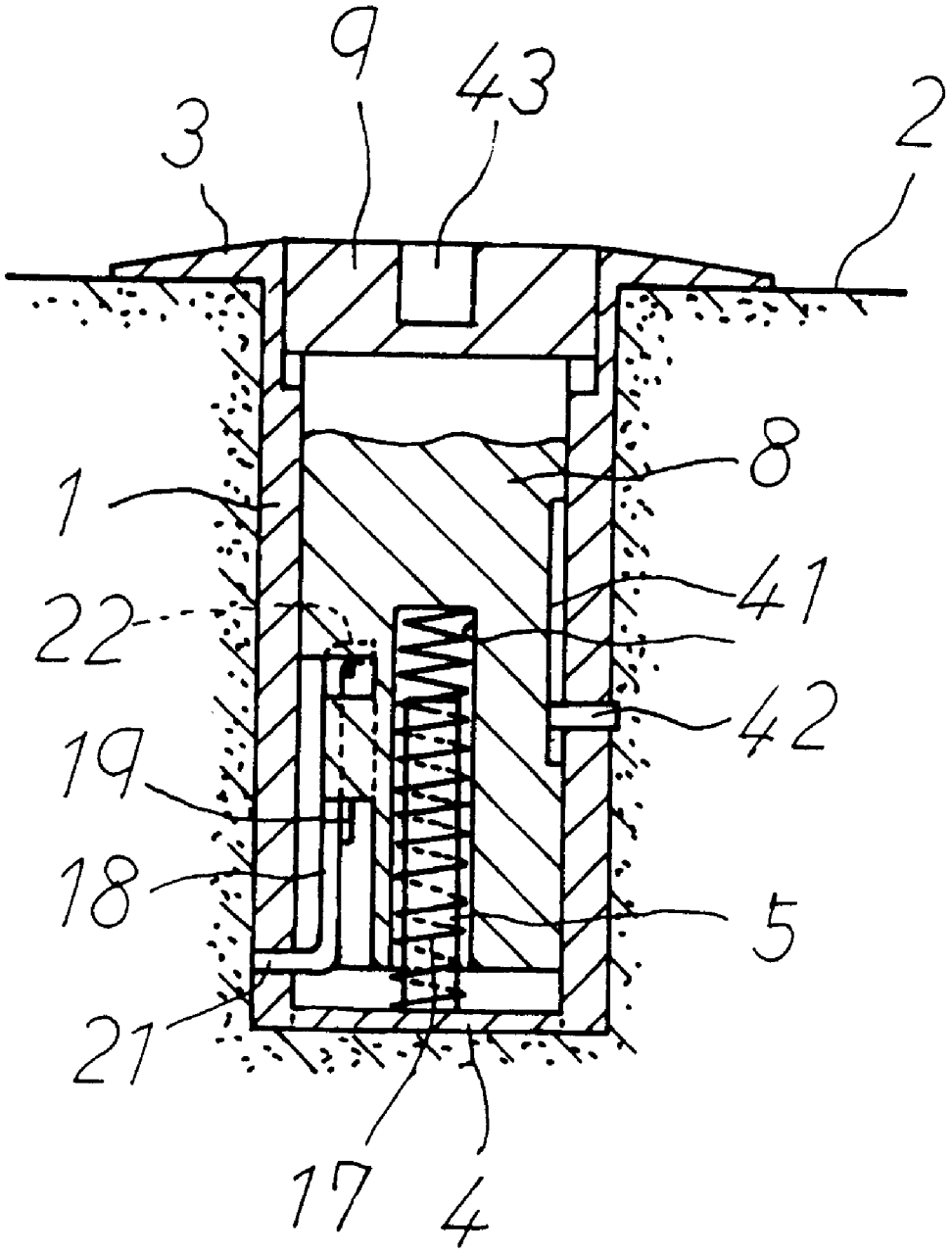
FIG. 7 is a longitudinal sectional view of the second embodiment showing the housed state.
Figure 8:
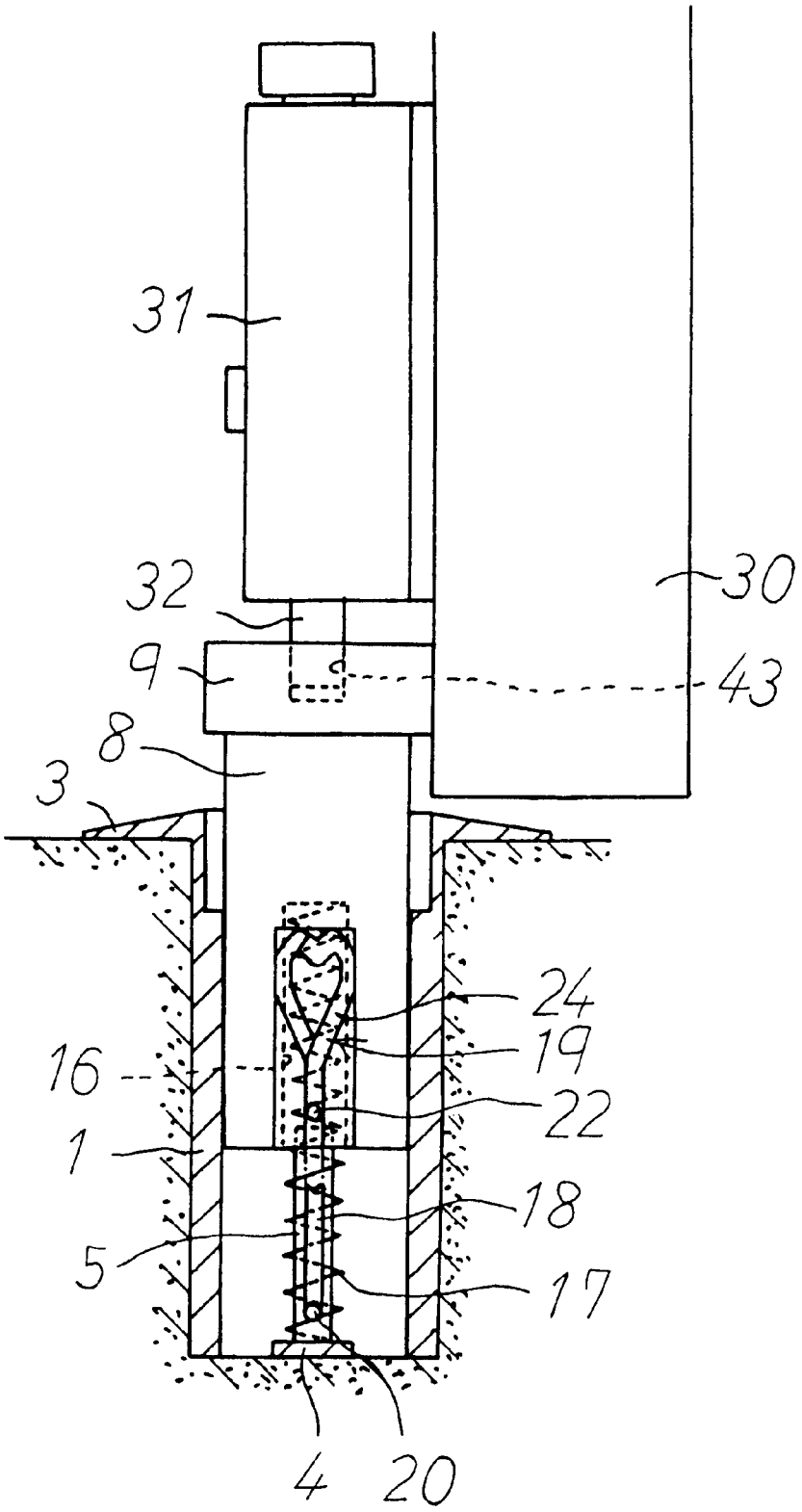
FIG. 8 is a partially sectional view of the second embodiment showing the relationship of the present invention with the door.

In the second embodiment shown in FIGS. 6 through 8 as well, the door contacting member 8 fits into the inner portion of the guide cylinder 1, where it is pushed upward by the coil spring 17. The lock mechanism having a heart-shaped grooved cam 19 with a step to prevent reversal, and a wire 18 keeps the door contacting member 8 in a housed state, as shown in FIGS. 6 and 7.

However, the door stopper of this second embodiment is not provided with a closing body that regulates the maximum raised position of the door contacting member 8 as in the first embodiment. In this second embodiment, the door contacting member 8 is circular post shaped with a vertical groove 41 for regulating the raising and lowering strokes formed in a part therein. A pin 42 formed protruding to the inner portion of the guide cylinder 1 fits into this vertical groove 41. Therefore, the maximum raised position of the door contacting member 8 is regulated by the pin 42 and the vertical groove 41.

Furthermore, with the door stopper of this second embodiment, a circular post-shaped door contacting member 8 fits into the inner portion of a cylindrical guide cylinder 1, thereby preventing dust from getting into the inner portion. A recessed portion 43 constituting a door holding portion is formed on the top of this door contacting member 8 such that a door 30 can be kept open by fitting a pin 32 of a metal fitting 31 mounted to the lower portion of the door 30, as shown in FIG. 8. Also, a head portion 9 of the door contacting member 8 prevents the door from hitting the wall when it is opened.

Figure 9:
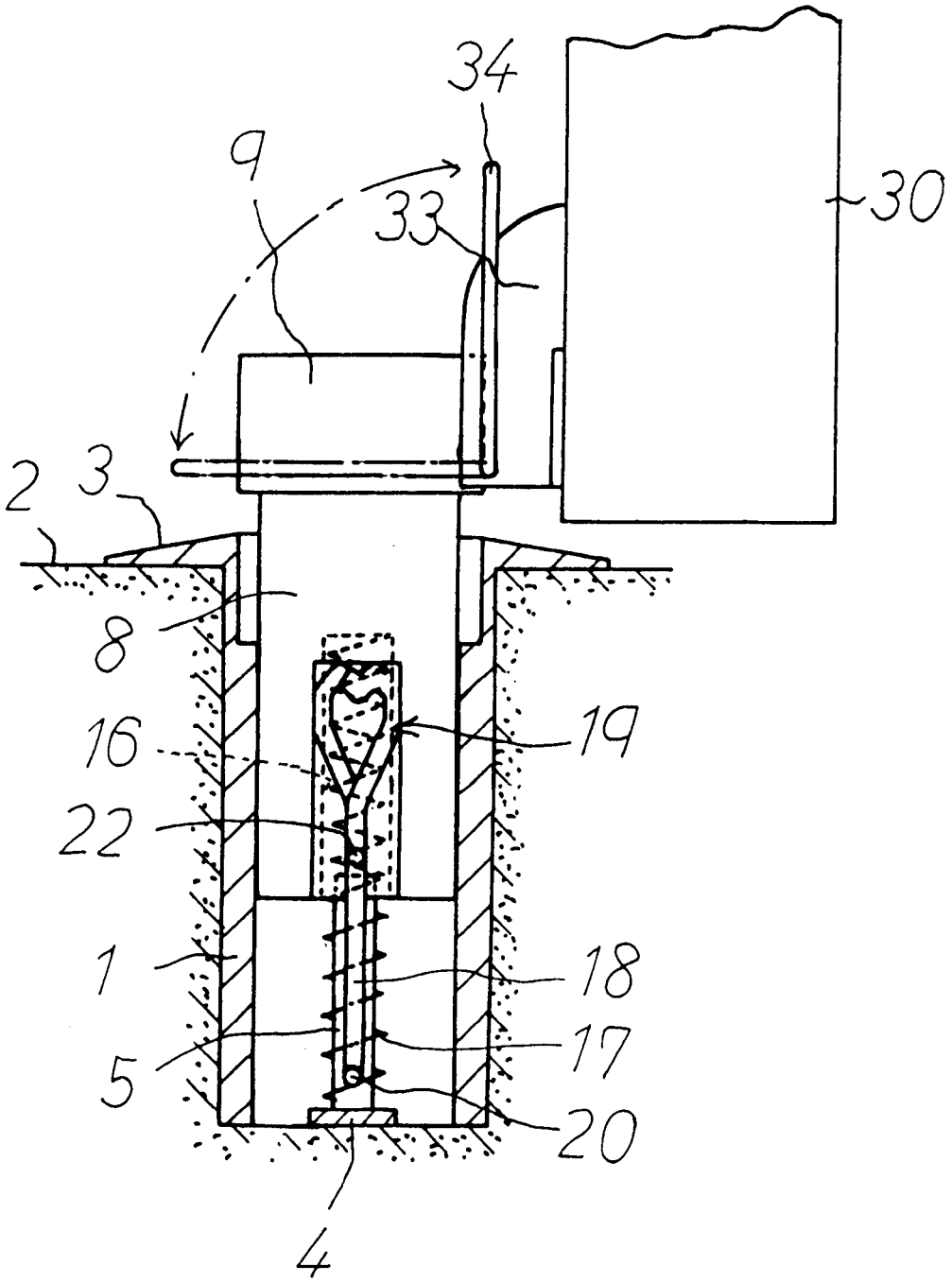
FIG. 9 is a partially sectional view showing a modified example of the second embodiment.

A vertically rotateable latch 34 is attached to the metal fitting 33 on the door 30, as shown in FIG. 9. By fitting this latch 34 over the head portion 9 of the door contacting member 8, the door 30 can be held in place. Furthermore, the portion where the hook formed on the door 30 is able to catch can also be provided on the head portion 9.

Figure 10:
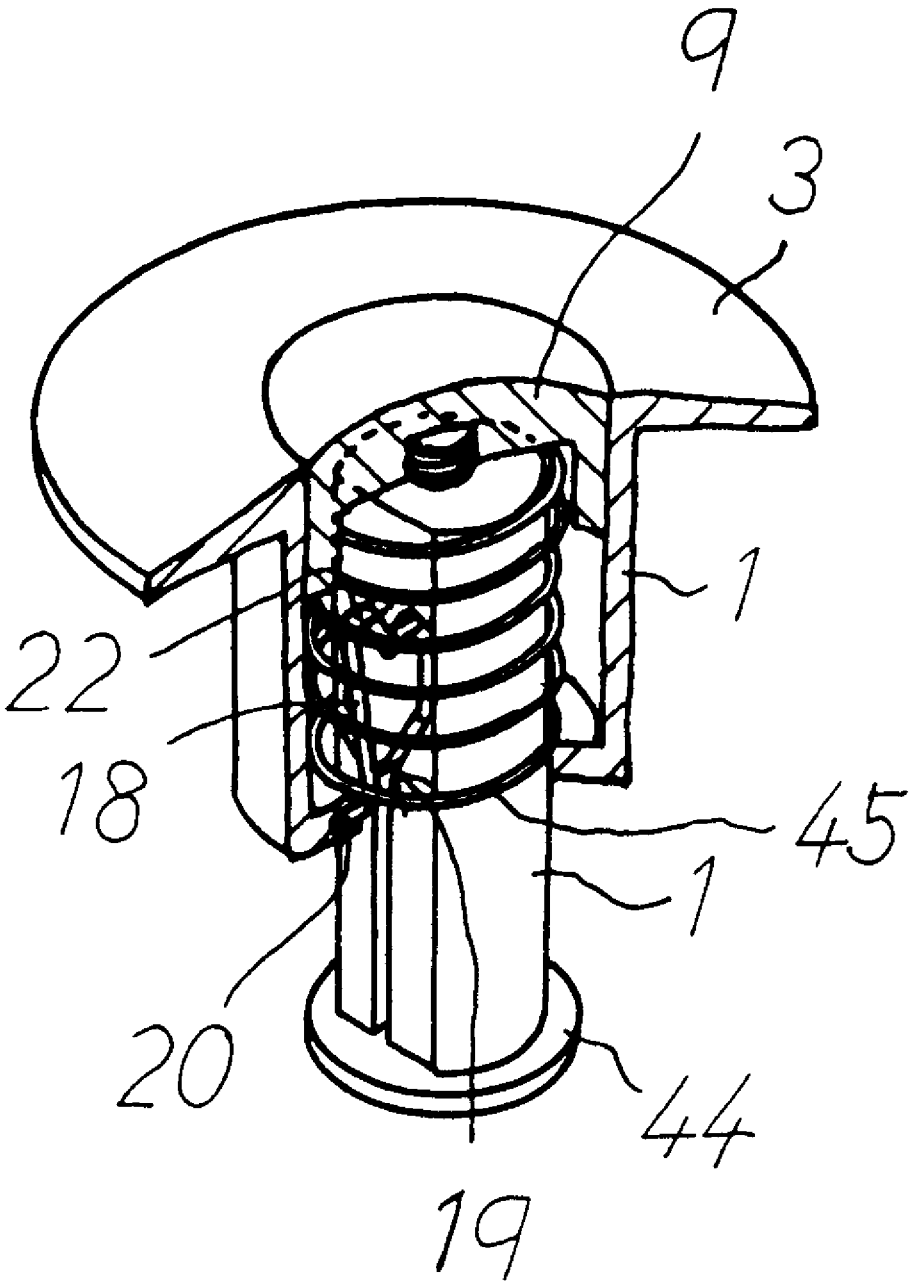
FIG. 10 is a partial cutaway perspective view showing the third embodiment of the present invention.

In the third embodiment shown in FIG. 10, the guide cylinder 1 is shortened and a flange 44 is formed on the lower end of the door contacting member 8 so as to regulate the maximum raised position of the door contacting member 8. Also in this third embodiment, a coil spring 45 is provided on the outer periphery of the door contacting member 8.

Figure 11:
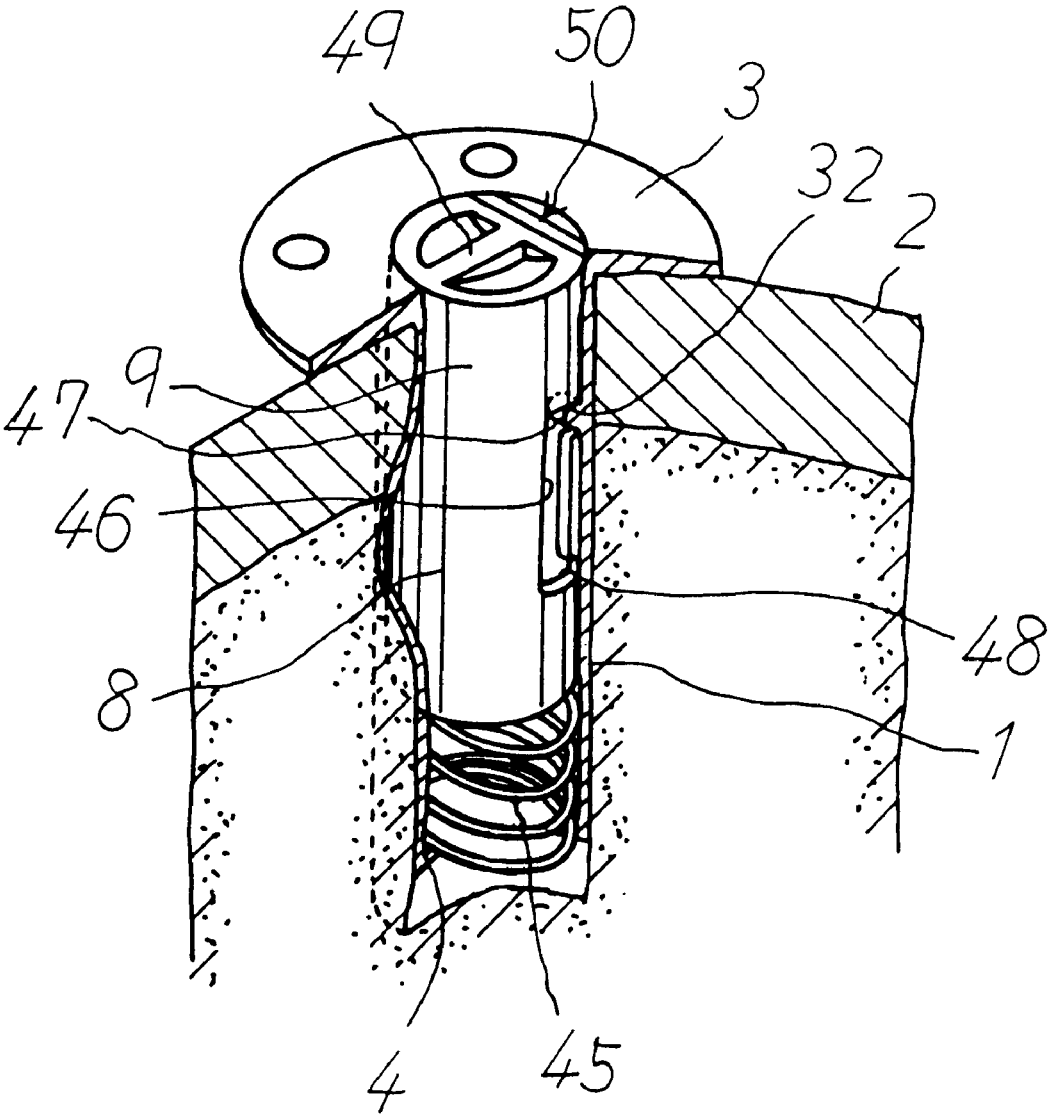
FIG. 11 is a partial cutaway perspective view showing the fourth embodiment of the present invention.
Figure 12:
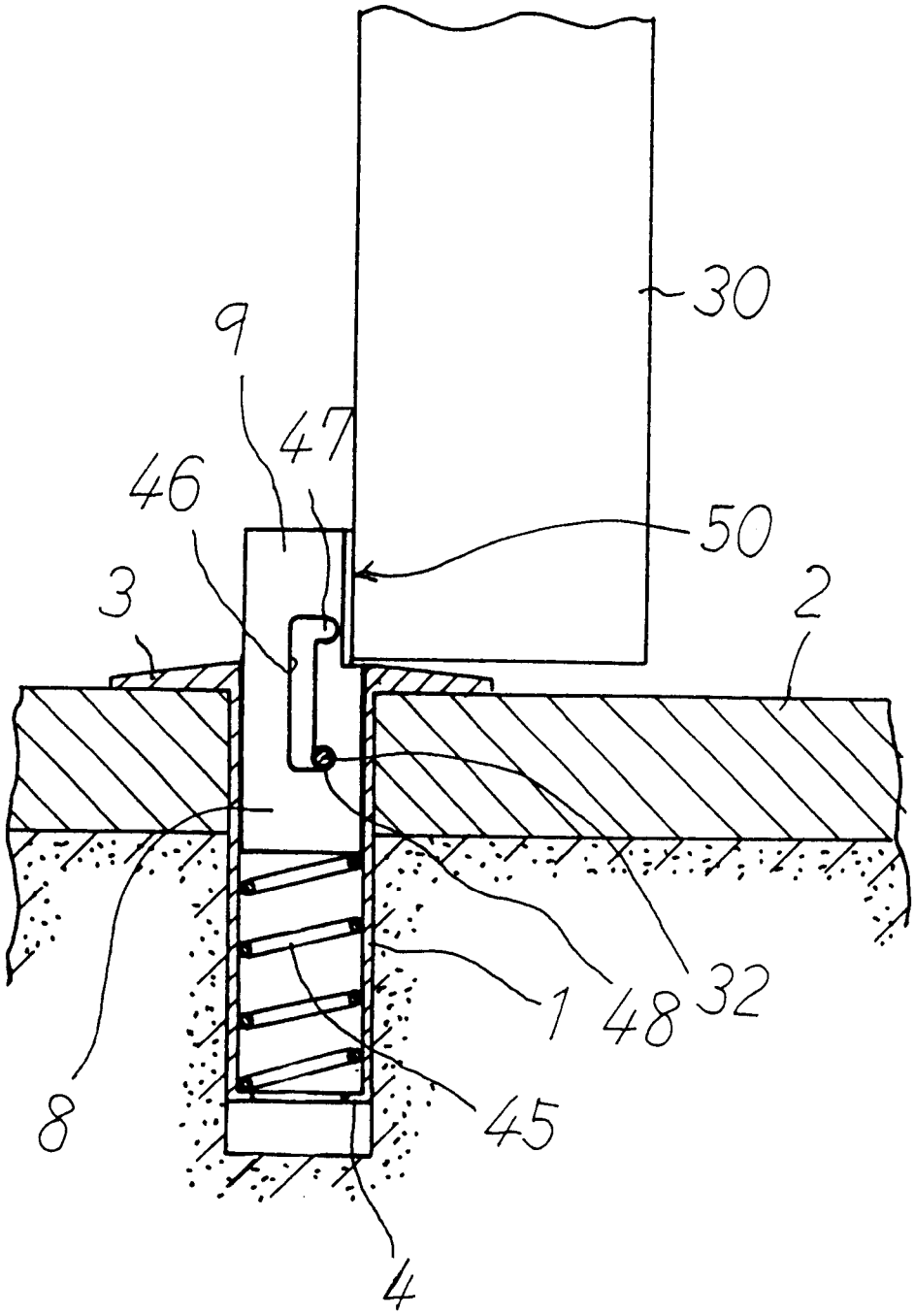
FIG. 12 is a partial cutaway perspective view of the fourth embodiment showing the relationship of the present invention with the door.

In all of the above described embodiments, a lock mechanism which keeps the door contacting member 8 is a housed state is provided with a heart-shaped grooved cam 19. However, as in the fourth embodiment shown in FIGS. 11 and 12, a grooved cam with horizontal portions 47, 48 at the top and bottom of a vertical groove 46 can also be used. In this embodiment, pressing the door contacting member 8 against the coil spring 45 and then rotating it engages the pin 32 of the guide cylinder 1 with the horizontal portion 47, thus keeping the door contacting member 8 in the housed state.

In order to rotate this type of door contacting member 8, a pinch dial 49 is formed in the head portion 9 of the door contacting member 8 in this embodiment. Also, it is preferable that the face of the head portion 9 which contacts the door 30 be flat and covered with a rubbery material 50.

As is clear from the description for each of the aforementioned embodiments, when the door stopper of the present invention is in a housed state, almost no portion of it protrudes above the floor so it does not get in the way of wheelchairs and during floor cleaning. Moreover, similar to conventional products, the door stopper of the present invention displays the functions of preventing an opened door from hitting the wall and keeping a door open. Therefore, the door stopper of the present invention is particularly suitable for use in barrier free housing.

What is claimed is:

1. A door stopper, comprising:

a guide cylinder for positioning generally vertically in a floor;

a door contacting member for positioning in said guide cylinder;

said door contacting member being movable relative to said guide cylinder to assume first and second positions;

an upper portion of said door contacting member extending above the floor when said door contacting member assumes said first position;

the upper portion of said door contacting member being substantially level with the floor when said door contacting member assumes said second position;

a lock mechanism for holding said door contacting member in said second position;

said lock mechanism comprising a pin in said guide cylinder and a generally heart-shaped grooved cam in said door contacting member for engaging said pin; and said grooved cam including a step to prevent reversal of said pin.

2. The door stopper of claim 1, wherein said grooved cam comprises a vertical groove with generally horizontal portions at top and bottom thereof.

3. The door stopper of claim 1, further comprising:

a vertical space between said door contacting member and said guide cylinder; and a closing body attached to an upper portion of said guide cylinder for closing an upper portion of the vertical space.

4. The door stopper of claim 1, further comprising:

a door holding portion attached to said door contacting member.

5. The door stopper of claim 1, further comprising:

means for regulating the position of the upper portion of said contacting member above the floor.

6. A door stopper, comprising:

a guide cylinder for positioning generally vertically in a floor;

a door contacting member for positioning in said guide cylinder;

said door contacting member being movable relative to said guide cylinder to assume first and second positions;

an upper portion of said door contacting member extending above the floor when said door contacting member assumes said first position;

the upper portion of said door contacting member being substantially level with the floor when said door contacting member assumes said second position;

a switching mechanism for switching said door contacting member between said first and second positions;

said switching mechanism comprising a pin in said guide cylinder, a generally heart-shaped grooved cam in said door contacting member for engaging said pin, and a spring positioned between said door contacting member and said guide cylinder for moving said door contacting member relative to said guide cylinder; and said groove cam including a step to prevent reversal of said pin.

7. The door stopper of claim 6, wherein:

said switching mechanism maintains said door contacting member in said second position against the force of said spring when said pin is positioned in an upper portion of said grooved cam, and in said first position when said door contacting member is raised by the force of said spring said pin is positioned in a lower portion of said grooved cam.

* * * * *